US006758475B2

(12) United States Patent
Newton

(10) Patent No.: US 6,758,475 B2
(45) Date of Patent: Jul. 6, 2004

(54) KARAOKE BOARD GAME

(76) Inventor: Glenn T. Newton, 4019 Schroeder Ave., Perry Hall, MD (US) 21128

( * ) Notice: Subject to any disclaimer, the term of this patent is extended or adjusted under 35 U.S.C. 154(b) by 0 days.

(21) Appl. No.: 10/305,605

(22) Filed: Nov. 26, 2002

(65) Prior Publication Data

US 2003/0098542 A1 May 29, 2003

Related U.S. Application Data

(60) Provisional application No. 60/333,321, filed on Nov. 26, 2001.

(51) Int. Cl.[7] ..... A63F 3/00

(52) U.S. Cl. ..... 273/242; 273/243; 273/301; 273/308; 273/432

(58) Field of Search ..... 273/243, 248, 273/301, 308, 430, 431, 432, 300; D21/334, 347, 353; 434/128, 129

(56) References Cited

U.S. PATENT DOCUMENTS 4,061,337 A 12/1977 Callender
4,690,025 A 9/1987 Hines et al.
4,932,667 A * 6/1990 Gorski et al. ..... 273/249
5,433,449 A * 7/1995 Sowek ..... 273/248
5,486,006 A 1/1996 Bruno et al.
5,893,561 A 4/1999 Hoffman
5,899,456 A * 5/1999 Weinstock et al. ..... 273/243
5,944,313 A 8/1999 Hockley
6,349,942 B1 2/2002 Solboe

* cited by examiner

*Primary Examiner*—Vishu K Mendiratta
(74) *Attorney, Agent, or Firm*—Law Offices of Royal W. Craig

(57) ABSTRACT

A music game, which incorporates the characteristics of the popular Karaoke singing phenomenon and draws upon the players' knowledge of songs and performing artists. The game includes game pieces, game board, die, timer, and Karaoke instruction cards. The game board consists of Karaoke, ATM and Stage Fright squares, each distinguished by a unique icon, interspersed along the perimeter of the board. The instruction cards have coordinating icons, each with specific instructions. A team member sings songs recorded by the performing artist identified on the card and the other team members must guess the artist. A correct guess allows the team to advance their game piece the number of squares rolled on the die. The object of the game is to be the first game piece to advance from Start to Finish by drawing cards, singing songs and guessing performing artists.

8 Claims, 3 Drawing Sheets

KARAOKE:

| | |
|---|---|
| **COUNTRY::** | CLINT BLACK |
| **POP:** | BRITNEY SPEARS |
| **ROCK & ROLL:** | ROLLING STONES |
| **OLDIES:** | ROY ORIBISON |

ATM: You forgot your ATM card. Move backwards to the Pop square. Draw another card.

STAGE FRIGHT: The crowd's singing throws you out of key. Move backwards to the Country square. End of turn.

KARAOKE:

| | |
|---|---|
| **COUNTRY:** | GARTH BROOKS |
| **POP:** | MICHAEL JACKSON |
| **ROCK & ROLL:** | AEROSMITH |
| **OLDIES:** | TEMPTATIONS |

ATM: Your bank account is empty. Move backwards to the Steal the Show square. Draw another card.

STAGE FRIGHT: Your Microphone feeds back. Move backwards to the Rock & Roll square. End of turn.

160

150

KARAOKE:

| | |
|---|---|
| **COUNTRY:** | FAITH HILL |
| **POP:** | ELTON JOHN |
| **ROCK & ROLL:** | PEARL JAM |
| **OLDIES:** | BEACH BOYS |

170

ATM: Your card gets eaten. Move backwards to the Rock & Roll square. End of turn.

180

STAGE FRIGHT: You're the best singer in the club. Advance to the Country square and draw another card.

FIG. 2

KARAOKE BOARD GAME

CROSS-REFERENCE TO RELATED APPLICATIONS

The present application is related to U.S. Provisional Patent Application 60/333,321 for "KARAOKE BOARD GAME"; Filed: Nov. 26, 2001; Inventor: Glenn T. Newton.

BACKGROUND OF THE INVENTION

1. Field of the Invention

The present invention relates generally to a music board game, and more particularly to a board game directed to players' knowledge about popular performing artists and their songs, whereby the players attempt to identify a performing artist within a specified time frame after hearing a team member sing songs by the artist.

2. Description of the Background

Board games are widely used as a means for family and friendly entertainment. Many board games include a game board, game pieces, and some means to advance the game pieces around the board. A number of such board games have had musical themes.

For example, U.S. Pat. No. 5,944,313 to Hockley shows a board game that requires identification of television theme songs from listening to audio cassettes.

U.S. Pat. No. 5,893,561 to Hoffman shows a board game directed to the players' knowledge of music to answer music trivia questions. Question cards relate to song titles, artists and lyrics.

U.S. Pat. No. 4,690,025 to Hines et al. shows a board game which involves the identification of a melody or song a after the players listen to a portion of the melody.

U.S. Pat. No. 4,061,337 to Callender shows a board game which requires comparison by the player of two representations and recognition of the association between the representations in the field of music.

U.S. Pat. No. 5,486,006 to Bruno et al. shows a question and answer format quiz game wherein a song title and year or song title and music category are identified and a player must identify the performing artist within a specified time period. The temporal and music categories are randomly selected by rolling a die.

There was also a series of board games published by the Hersch Company in the early 1990's, all of which required players to complete lyrics to popular songs.

While each of the foregoing examples calls upon the knowledge of players with respect to artists, songs and lyrics, none combine these requirements in a Karaoke format with actual singing, while calling upon the players' knowledge of performing artists and the lyrics and melody of their songs. It would be greatly advantageous to provide a music theme board game that incorporates characteristics of the popular Karaoke singing phenomenon, while calling upon the players' knowledge of performing artists and the lyrics and melody of their songs.

SUMMARY OF THE INVENTION

It is, therefore, an object of the present invention to provide a music theme board game apparatus and method that provide home entertainment and amusement in a tongue-in-cheek Karaoke setting, with teams of players progressing around a board through various Karaoke clubs, automated teller machines (to pay for the club expenses), etc.

It is another object to provide a music theme board game as described above that incorporates characteristics of the popular Karaoke singing phenomenon, while calling upon the players' knowledge of performing artists and the lyrics and melody of their songs, thereby requiring a combination of knowledge and talent to win.

It is another object to provide a music theme board game as described above that may be easily and efficiently manufactured.

According to the present invention, the above-described and other objects are accomplished by providing a music-theme board game for play by two or more teams with two or more players on each team. The game comprises a game board, a set of instruction cards, a plurality of game pieces, a die, and a one minute timer. Said game board contains a plurality of squares, representing Karaoke Club, ATM, and Stage Fright categories, interspersed and forming a path around the perimeter of the board, with a "Take the Stage" (start) square at the beginning and a "Take a Bow" (finish) square at the end of the path. A game piece is given to each team and the object of the game is to advance the game piece around the path from "Take the Stage" to "Take a Bow" and to be the first team to reach the "Take a Bow" square. The teams alternate turns by drawing an instruction card and following Icon-coded instructions that correspond to the square where the team's game piece rests. For example, the Icon for Rock & Roll is a guitar, shown both on the board square for Rock & Roll and on the instruction card for the Rock & Roll category. Karaoke clubs are represented by the following squares: Country, Pop, Rock & Roll, Oldies, U Choose, Steal the Show, Take the Stage, and Take a Bow. The Country, Pop, Rock & Roll, and Oldies Karaoke squares correspond to the same specific categories of artists on the instruction cards. The U Choose and Steal the Show Karaoke squares can be any of the four music Karaoke categories: Country, Pop, Rock & Roll, or Oldies, depending upon the player's choice. The Take the Stage and Take a Bow Karaoke squares start and finish the game, respectively. Each instruction card identifies a country, pop, rock and roll, and oldies performing artist. A team member must sing songs by the artist in an attempt to get his or her other team members to guess the name of the artist. If the team members guess the artist in the predetermined amount of time, the team gets to roll the die and move their game piece along the path according to the number of squares rolled on the die. The team continues playing until they fail to guess an artist in the required time frame or until an instruction states, "End of Turn". As an alternative to singing clues, the participants may choose to give word clues about the artist. However, if the player uses word clues, and his or her team guesses the artist, the team's turn ends after they roll the die and advance their game piece according to the number rolled on the die. ATM and Stage Fright squares provide instructions regarding advancing or retreating the team's game piece, and generally end the team's turn.

BRIEF DESCRIPTION OF THE DRAWINGS

Other objects, features, and advantages of the present invention will become more apparent from the following detailed description of the preferred embodiment and certain modifications thereof when taken together with the accompanying drawings in which:

FIG. 2 is a representation of exemplary instruction cards 150.

DETAILED DESCRIPTION OF THE PREFERRED EMBODIMENTS

The present invention is a music-theme board game for play by two or more teams with two or more players on each team. The game includes a game board, a set of instruction cards, a plurality of game pieces, a die, and a timer. The game board forms a path around the perimeter of the board. A game piece is given to each team and the object of the game is to advance the game piece around the path. The teams alternate turns by drawing an instruction card and following instructions thereon.

Figure 1:
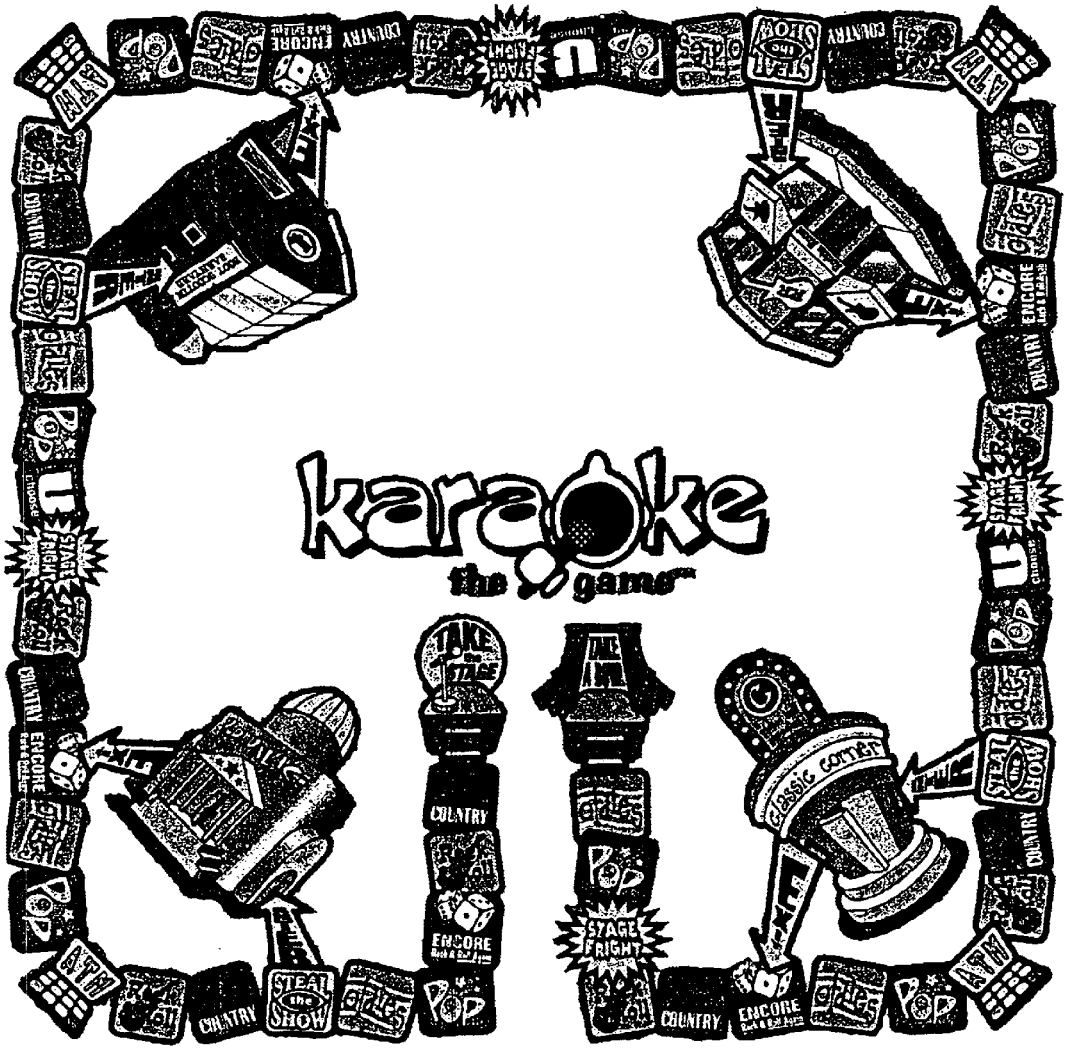
FIG. 1 is a picture of the game board 10 according to the present invention.

FIG. 1 is a picture of the game board 10 according to the present invention. The game board 10 consists of Karaoke squares 20, ATM squares 30 and Stage Fright 40 squares interspersed along a path 50 around the perimeter of the board, with a "Take the Stage" square 60 at the beginning to start the game and a "Take a Bow" square 70 at the end of the path to end the game.

FIG. 2 is a representation of exemplary instruction cards. Each instruction card 150 has a set of six icon-coded instructions; Country, Pop, Rock & Roll, Oldies 160, ATM 170, and Stage Fright 180. The icons (e.g., guitar for Rock & Roll) on the instruction cards correspond to the squares on the game board 10. The Karaoke Club instructions 160, comprised of Country, Pop, Rock & Roll, Oldies instructions, are the most entertaining instructions and provide a means to advance the game piece around the game board path more quickly. The Country, Pop, Rock & Roll, and Oldies instructions are performing artists, such as the exemplary Beach Boys instruction. The player that draws the card has the option of singing songs or giving word clues for his or her team members to guess the artist. In the Beach Boys example, the player could either sing songs performed by the Beach Boys, e.g., Help Me Rhonda, Barbara Ann, or give word clues about the Beach Boys, e.g., 'a group popular in the 60's with the surfer crowd'. The other members of the team must guess the correct answer before the timer runs out. The timer starts when the player draws a card. The ATM instruction 170 provides some positive or negative information regarding an ATM withdrawal and instructions to advance or retreat a specific number of squares accordingly. An exemplary ATM instruction states, "Your card gets eaten. Move backward to the Rock & Roll square. End of turn." The Stage Fright instruction 180 is a Karaoke "Event". Generally, the Stage Fright instruction provides some positive or negative information about the Karaoke singing experience and instructions to advance or retreat to a specific square accordingly. An exemplary Stage Fright instruction states, "You're the best singer in the club. Advance to the Country square and and draw another card." If the team lands on an ATM or Stage Fright square, the player drawing the card reads and follows the corresponding ATM or Stage Fright instructions.

Referring back to FIG. 1, to play the game, the players are divided into at least two teams of at least two players each and each team places a game piece on the Take the Stage square 60. The object of the game is to be the first team whose game piece reaches the Take a Bow square 70 and to successfully guess the artist for the particular Karaoke category chosen. Generally, the starting team is selected, for instance, by a team member from each team rolling a die and the team with the highest roll starts the game. The teams alternate turns, for instance, in a clockwise fashion.

In general play, one team member from the starting team draws an instruction card from the stack of instruction cards. The Take the Stage square 60 is a Karaoke Club square and the team must choose a music category before drawing a card. The available categories are: Country, Pop, Rock & Roll, and Oldies. A performing artist is listed next to each category. At this point, the player has a choice of singing songs performed by the artist or giving word clues about the artist in an attempt to elicit the correct artist name from his or her team members. With either option, the team has a pre-determined time (e.g., one minute) to guess the artist. The one minute timer starts when the card is drawn. However, the team member has the option of passing on the first card drawn and drawing up to two more cards. If the team member passes on the first two cards, the third card drawn becomes an "All Play" whereby all teams participate in guessing the artist. If the team fails to guess the artist in the pre-determined time frame, the turn passes to the next team. Alternatively, if the team guesses the artist before the timer runs out, the team rolls the die and advances their game piece the number of squares rolled on the die. If the team guessed the artist by word clues, the team rolls the die, advances the marker according to the number rolled on the die, and the team's turn ends. If the team guesses the artist by singing, their turn continues and a team member draws another card. If the game piece has landed on a Karaoke square 20, a team member follows the instructions for one of the Karaoke categories, (i.e., Country, Pop, Rock & Roll, and Oldies), giving word or singing clues for the team to guess the artist. As long as the team continues to correctly guess the artist from singing clues and continues to land on Karaoke squares, the team's turn continues. If the game piece is advanced to an ATM square 30 or a Stage Fright square (Karaoke "Event") 40, the team member follows the ATM or Stage Fright instructions on the instruction card, respectively, which generally results in the team moving backwards on the board. ATM and Stage Fright instructions will generally advance or retreat the game piece to a specific square based on an event. ATM instructions are anecdotes involving withdrawing money from an ATM to pay for Karaoke club expenses and Stage Fright instructions are anecdotes involving Karaoke events, such as crowd reaction. The game continues, alternating turns, until a team's game piece is the first to reach the "Take a Bow" square and successfully guess the artist identified on the drawn card. By singing songs and correctly guessing the artist (Karaoke instructions), a team advances toward the finish at a faster pace, while amusing each other with their skills and knowledge of music.

Figure 3:
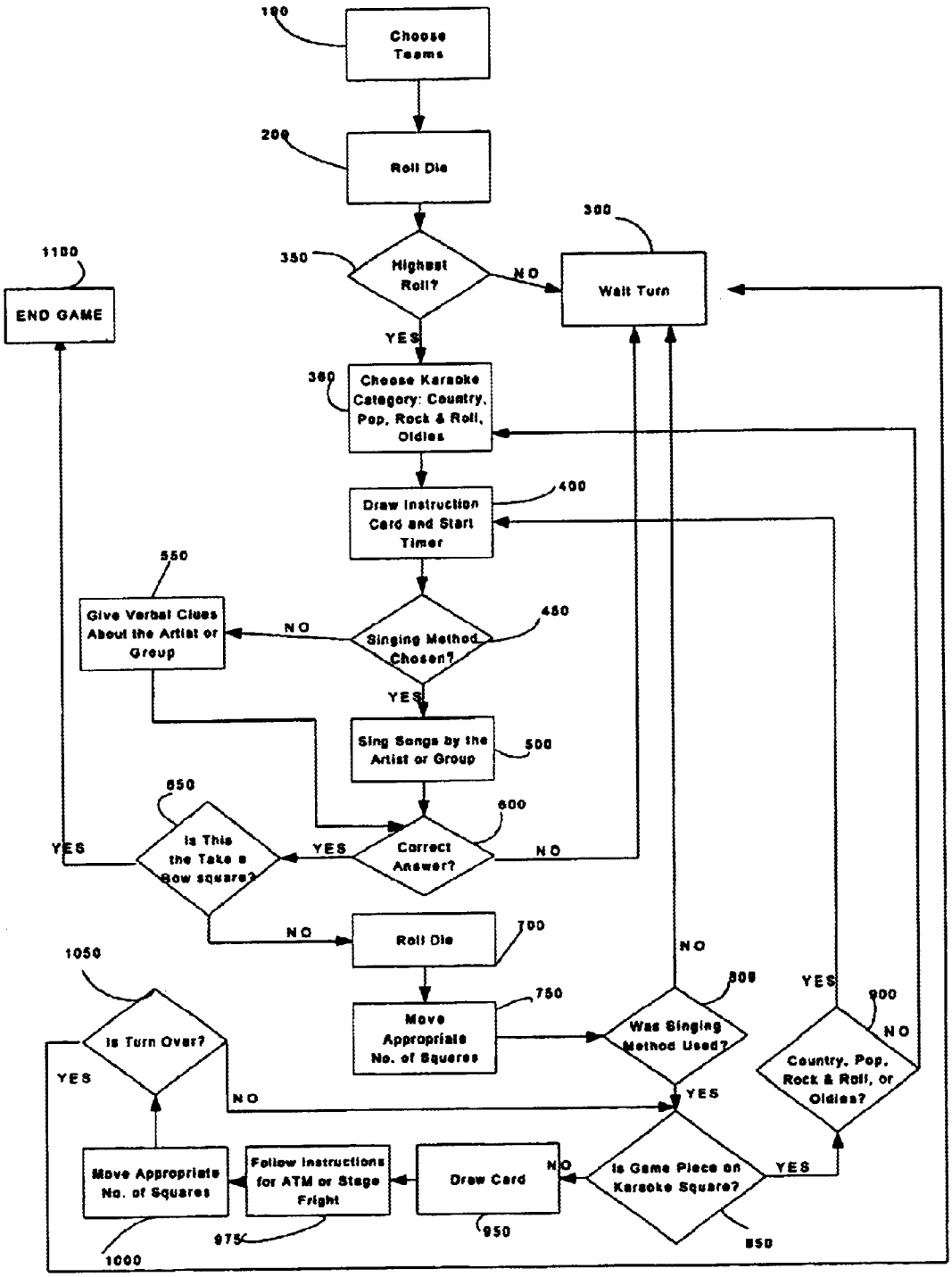
FIG. 3 is a flow diagram of the method for playing the game according to the present invention.

FIG. 3 is a more detailed flow diagram of the game method according to the present invention.

At Step 100, to begin the game, the players divide into at least two teams of at least two players each. At Step 200, a designated player from each team rolls the die. At 350, it is determined which team rolls the highest number. The team with the highest roll goes to Step 360 and chooses a Karaoke category (i.e., Country, Pop, Rock & Roll, and Oldies), then goes to Step 400 and starts play by drawing an instruction card. The other teams that did not roll the highest number wait their turn at Step 300. The teams alternate turns clockwise.

At Step 400, the player draws an instruction card and the one minute timer is activated. At 450, the player determines whether he or she will sing or give verbal clues. If the player decides to sing, he or she goes to Step 500 to sing songs by the performing artist or group. Alternatively, if the player decides not to sing, he or she moves to Step 550 to give verbal clues about the recording artist or group. In either case, if, at 600, the team does not name the correct artist in the prescribed time frame, the team loses its turn and goes back to Step 300 to await its next turn. If, on the other hand, at 600 the team does successfully name the correct artist in the prescribed time frame and the Karaoke square is the "Take a Bow" square (i.e., Step 650=YES), the team wins the game and the game is over at Step 1100. Alternatively, if, at 600, the team successfully names the performing artist, but the Karaoke square is not the "Take a Bow" square at 650, the team member rolls the die at Step 700. The team moves its game piece the number of squares rolled on the die at Step 750. At 800, if the team used the verbal clue method, the team's turn is over and the team returns to Step 300 to await its turn. If the team used the singing clues method, the team's turn is not over and at 850 a decision is made as to whether the game piece is now on a Karaoke square. If the game piece is on a Karaoke square and the square is either a Country, Pop, Rock & Roll, and Oldies square at 900, they return to Step 400 to draw another instruction card. If, alternatively, the game piece is on a Karaoke square, but at 900, the Karaoke square is not a Country, Pop, Rock & Roll, and Oldies square (i.e., it is a U Choose, Steal the Show, Take the Stage, or Take a Bow square), they return to Step 360 to choose a Karaoke category.

If, at 850, the game piece is not on a Karaoke square, i.e., it is on an ATM or Stage Fright square, at Step 950, a team member draws a card and at Step 975 reads and follows the respective ATM or Stage Fright instruction on the card that corresponds to the square where the game piece is located. The player then goes to Step 1000 and moves the game piece the appropriate number of squares forward or backward as indicated in the instruction. If the Stage Fright or ATM instructions provide that their turn continues they return to Step 850. Conversely, if the instruction specifies that their turn ends, they move to Step 300 to await their next turn.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. A method of playing a music-theme board game comprising the steps of:

selecting at least two teams comprising at least two players per team;

said teams alternately rolling a die and advancing a game piece along a game board path that includes Karaoke squares interspersed among other squares;

one player drawing an instruction card whenever his team lands on a Karaoke square, said instruction card including a performing artist name;

said player optionally singing said artists songs or giving word clues about said artist in an attempt to elicit the correct artist name from his or her team member;

wherein if a team guesses the artist by word clues the team rolls the die, moves their game piece in accordance therewith and ends their turn, and if said team guesses the artist by singing, their turn continues and they roll the die, move their game piece in accordance therewith, and draw another card.

2. The method of playing a music-theme board game according to claim 1, wherein said instruction card also includes specific squares to be advanced or retreated to, and said method further comprises the step of advancing or retreating the game piece along the path of the game board to the square instructed by the instruction card.

3. The method of playing a music-theme board game according to claim 1, wherein said other squares include ATM squares.

4. The method of playing a music-theme board game according to claim 1, wherein said other squares include Stage Fright squares.

5. The method of playing a music-theme board game according to claim 1, wherein said Karaoke squares include Pop, County, Rock & Roll, and Oldies squares.

6. The method of playing a music-theme board game according to claim 1, wherein said Karaoke squares include U Choose, Steal the Show, Take the Stage, and Take a Bow squares, whereby the player chooses the Karaoke category from Pop, Country, Rock & Roll, and Oldies.

7. The method of playing a music-theme board game according to claim 6, wherein said Steal the Show squares represent an all play situation whereby all teams play the turn.

8. The method of playing a music-theme board game according to claim 6, wherein said Take the Stage square represents the start of the game and said Take a Bow square represents the finish of the game.

* * * * *